US007452287B2

(12) United States Patent
Erickson et al.

(10) Patent No.: US 7,452,287 B2
(45) **Date of Patent: *Nov. 18, 2008**

(54) MULTIPLE MATERIAL GOLF CLUB HEAD

(75) Inventors: Matthew J. Erickson, San Diego, CA (US); Bradley C. Rice, Carlsbad, CA (US); D. Clayton Evans, San Marcos, CA (US); Evan D. Gibbs, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/928,255

(22) Filed: Oct. 30, 2007

(65) Prior Publication Data

US 2008/0051219 A1 Feb. 28, 2008

Related U.S. Application Data

(63) Continuation of application No. 11/841,284, filed on Aug. 20, 2007, which is a continuation of application No. 11/423,589, filed on Jun. 12, 2006, now Pat. No. 7,258,630, which is a continuation of application No. 10/907,085, filed on Mar. 18, 2005, now Pat. No. 7,059,973.

(51) Int. Cl.
*A63B 53/04* (2006.01)

(52) U.S. Cl. ..... 473/345; 473/349

(58) Field of Classification Search ..... None
See application file for complete search history.

(56) References Cited

U.S. PATENT DOCUMENTS

| | | | |
|---|---|---|---|
| 1,167,387 | A | 1/1916 | Daniel |
| 1,638,916 | A | 8/1927 | Butchart |
| 1,780,625 | A | 11/1930 | Mattern |
| 2,750,194 | A | 6/1956 | Clark |
| 3,692,306 | A | 9/1972 | Glover |
| 3,897,066 | A | 7/1975 | Belmont |
| 3,937,474 | A | 2/1976 | Jepson et al. |
| 3,975,023 | A | 8/1976 | Inamori |
| 3,989,248 | A | 11/1976 | Campau |
| 4,021,047 | A | 5/1977 | Mader |
| 4,398,965 | A | 8/1983 | Campau |

(Continued)

FOREIGN PATENT DOCUMENTS

JP 2000300700 A * 10/2000

*Primary Examiner*—Eugene Kim
*Assistant Examiner*—Alvin A Hunter
(74) *Attorney, Agent, or Firm*—Michael A. Catania; Elaine H. Lo

(57) ABSTRACT

A wood-type golf club head (40) having a major body (50), a striking plate insert (55) and a minor body (60) is disclosed herein. The major body (50) is composed of a metal material and has a front wall section (72), a return section (74), a sole section (76), a ribbon section (78) and a ledge portion (80). The minor body (50) is preferably composed of a low density material and has a crown section (62) and a ribbon section (64). The striking plate insert (55) is composed of a metal material. An epoxy-based composition (200) is placed at a face-sole junction (205) to lower the amplitude of the sound of the golf club head (40) during impact with a golf ball.

2 Claims, 14 Drawing Sheets

U.S. PATENT DOCUMENTS

| | | | | |
|---|---|---|---|---|
| 4,568,088 | A | 2/1986 | Kurahashi | |
| 4,872,685 | A | 10/1989 | Sun | |
| 4,877,249 | A | 10/1989 | Thompson | |
| 5,106,094 | A | 4/1992 | Deboilles et al. | |
| 5,193,811 | A | 3/1993 | Okumoto et al. | |
| 5,282,624 | A | 2/1994 | Viste | |
| 5,310,185 | A | 5/1994 | Viollaz et al. | |
| 5,344,140 | A | 9/1994 | Anderson | |
| 5,346,216 | A | 9/1994 | Aizawa | |
| 5,377,986 | A | 1/1995 | Viollaz et al. | |
| 5,398,935 | A | 3/1995 | Katayama | |
| 5,410,798 | A | 5/1995 | Lo | |
| 5,425,538 | A | 6/1995 | Vincent et al. | |
| 5,499,814 | A | 3/1996 | Lu | |
| 5,516,107 | A | 5/1996 | Okumoto et al. | |
| 5,547,427 | A | 8/1996 | Rigal et al. | |
| 5,570,886 | A | 11/1996 | Rigal et al. | |
| 5,624,331 | A | 4/1997 | Lo et al. | |
| 5,637,045 | A | 6/1997 | Igarashi | |
| 5,743,813 | A | 4/1998 | Chen et al. | |
| 5,776,011 | A | 7/1998 | Su et al. | |
| 5,863,261 | A | 1/1999 | Eggiman | |
| 5,967,904 | A | 10/1999 | Nagai et al. | |
| 5,979,855 | A | 11/1999 | Maier | |
| 6,048,278 | A * | 4/2000 | Meyer et al. | 473/345 |
| 6,071,200 | A | 6/2000 | Song | |
| 6,146,571 | A | 11/2000 | Vincent et al. | |
| 6,149,534 | A | 11/2000 | Peters et al. | |
| 6,162,130 | A | 12/2000 | Masumoto et al. | |
| 6,238,301 | B1 | 5/2001 | Takeda | |
| 6,334,817 | B1 | 1/2002 | Ezawa et al. | |
| 6,354,962 | B1 | 3/2002 | Galloway et al. | |
| 6,491,592 | B2 | 12/2002 | Cackett et al. | |
| 6,575,845 | B2 | 6/2003 | Galloway et al. | |
| 6,645,086 | B1 | 11/2003 | Chen | |
| 6,648,773 | B1 | 11/2003 | Evans | |
| 6,663,504 | B2 | 12/2003 | Hocknell et al. | |
| 6,669,577 | B1 | 12/2003 | Hocknell et al. | |
| 6,719,643 | B1 | 4/2004 | Helmstetter et al. | |
| 6,785,126 | B2 | 8/2004 | Hazzard et al. | |
| 6,800,040 | B2 | 10/2004 | Galloway et al. | |
| 6,875,129 | B2 | 4/2005 | Erickson et al. | |
| 6,881,159 | B2 | 4/2005 | Galloway et al. | |
| 6,890,270 | B2 | 5/2005 | Ciasullo | |
| 6,902,497 | B2 | 6/2005 | Deshmukh et al. | |
| 6,926,616 | B1 | 8/2005 | Kusumoto et al. | |
| 6,932,716 | B2 | 8/2005 | Ehlers et al. | |
| 6,945,877 | B2 | 9/2005 | Kobayashi et al. | |
| 6,949,031 | B2 | 9/2005 | Imamoto et al. | |
| 6,964,617 | B2 | 11/2005 | Williams | |
| 7,059,973 | B2 * | 6/2006 | Erickson et al. | 473/345 |
| 7,258,630 | B2 * | 8/2007 | Erickson et al. | 473/345 |
| 2004/0248667 | A1 * | 12/2004 | Cackett et al. | 473/349 |

* cited by examiner

MULTIPLE MATERIAL GOLF CLUB HEAD

CROSS REFERENCES TO RELATED APPLICATIONS

The Present application is a continuation application of U.S. patent application Ser. No. 11/841,284, filed on Aug. 20, 2007, which is a continuation application of U.S. patent application Ser. No. 11/423,589, filed on Jun. 12, 2006, now U.S. Pat. No. 7,258,630, which is a continuation application of U.S. patent application Ser. No. 10/907,085, filed on Mar. 18, 2005, now U.S. Pat. No. 7,059,973.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with a major body composed of a metal material, and a minor body composed of a light-weight material. More specifically, the present invention relates to a golf club head with a major body composed of a metal material for a more efficient transfer of energy to a golf ball at impact, and a non-metallic minor body to control the mass distribution.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10-100 times larger than the damping properties of a metallic club face. Thus, during impact most of the energy is lost as a result of the high stresses and deformations of the golf ball (0.001 to 0.20 inch), as opposed to the small deformations of the metallic club face (0.025 to 0.050 inch). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Aizawa, U.S. Pat. No. 5,346,216 for a Golf Club Head, discloses a face plate having a curved ball hitting surface.

U.S. Pat. No. 6,146,571 to Vincent, et. al., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element preferably being between 2.5 and 5 mm in thickness.

U.S. Pat. No. 5,425,538 to Vincent, et al., discloses a hollow golf club head having a steel shell and a composite striking surface composed of a number of stacked woven webs of fiber.

U.S. Pat. No. 5,377,986 to Viollaz, et al., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 and 15 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al. discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight being preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

U.S. Pat. No. 5,351,958 to Helmstetter discloses the use of "mouseglue" in a golf club head to capture pieces or particles within the club head.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e which measures club face COR. This USGA test procedure, as well as procedures like it, may be used to measure club face COR.

Sound, or specifically sound waves are longitudinal mechanical waves that compress a medium such as air to stimulate the human ear and brain for the sensation of hearing. The frequency range that can stimulate the human ear for hearing is designated the audible range and ranges from 20 Hertz (cycles) to 20,000 Hertz. The sound waves create a pressure that varies depending on the medium, the frequency and distance. The human ear can tolerate a sound pressure of 28 Pascals, and can detect a sound pressure as low as 2.0.times. $10^5$ Pascals. Sound, or the sound level, is measured in decibels (named after Alexander Graham Bell), and is a parameter related to the intensity of a sound wave according to the following equation:

$$SPL=10\log_{10}(I/Io)$$

wherein I is the intensity and Io is a standard reference intensity ($Io=10^{-12}$ W/m$^2$). The intensity I may be found from the pressure amplitude wherein the average intensity $I=(½)P_m^2/v$ wherein $P_m$=the pressure amplitude of the sound in air, v=the velocity of sound in air, and o=the density of air. When I=Io, the sound level is zero decibels which is the threshold of hearing. For reference, a whisper is twenty decibels, normal conversation is sixty decibels, a pneumatic drill at a distance of three meters has a sound level of ninety decibels, and a jet engine at fifty meters has a sound level of one hundred thirty decibels. A golf club striking a golf ball will emit certain sound levels according to the material and construction of the golf club.

Golfers have become accustomed to hearing a particular sound when the club face impacts the golf ball, especially when a driver or fairway wood is used by the golfer. This "sound expectation" has grown tremendously since the introduction of hollow metal woods. This particular sound imparts a sensation to the golfer of a good shot, a quality club or both.

The sound expectation from a metal wood has become so entrenched that woods lacking this particular sound are believed to be inferior or are undesired by golfers. This sound expectation has greatly effected multiple material, large volume golf clubs since current multiple material, large volume golf clubs have an undesirable tone.

Further, the current manufacturers of multiple material, large volume (over 350 cc) golf clubs have had no desire to improve the sound since improving the performance and lowering the costs of these golf clubs have been the major design concerns of such manufacturers. Thus, although the performance and price of multiple material, large volume golf clubs have improved, the sound has remained unchanged and is an obstacle to increased acceptance of multiple material, large volume golf clubs.

Although the prior art has disclosed many variations of multiple material club heads, the prior art has failed to provide a multiple material, large volume club head with a sufficient volume and an appealing sound during impact with a golf ball.

BRIEF SUMMARY OF THE INVENTION

The present invention provides a golf club with a golf club head having a metal major body and a light-weight minor body in order to provide a golf club head with a high moment of inertia, greater forgiveness and a better tone. The golf club heads are preferably over 300 cubic centimeters in volume.

One aspect of the present invention is a golf club head including a major body composed of a metal material, a striking plate insert, and a minor body composed of a non-metal material. The major body has a front wall section, a return section, a sole section, a ribbon section and a ledge section. The striking plate insert preferably has a thickness in the range of 0.010 inch to 0.250 inch. The return section has a thickness in the range of 0.010 inch to 0.200 inch. The minor body has a crown section and a ribbon section. The minor body is attached to the ledge section of the major body. A plurality of stiffening members are disposed on the sole section of the major body to enhance the tone of the golf club head during impact with a golf ball. Additionally, an epoxy-based composition is positioned at a face-sole junction in order to reduce the amplitude of the sound generated by the golf club head during impact with a golf ball.

In a preferred embodiment, the amplitude level was reduced from 118 decibels for a similar golf club head without the epoxy-based composition to 110 decibels for a golf club head with the epoxy based composition. Those skilled in the pertinent art will recognize that this is more than a two-time reduction in amplitude.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
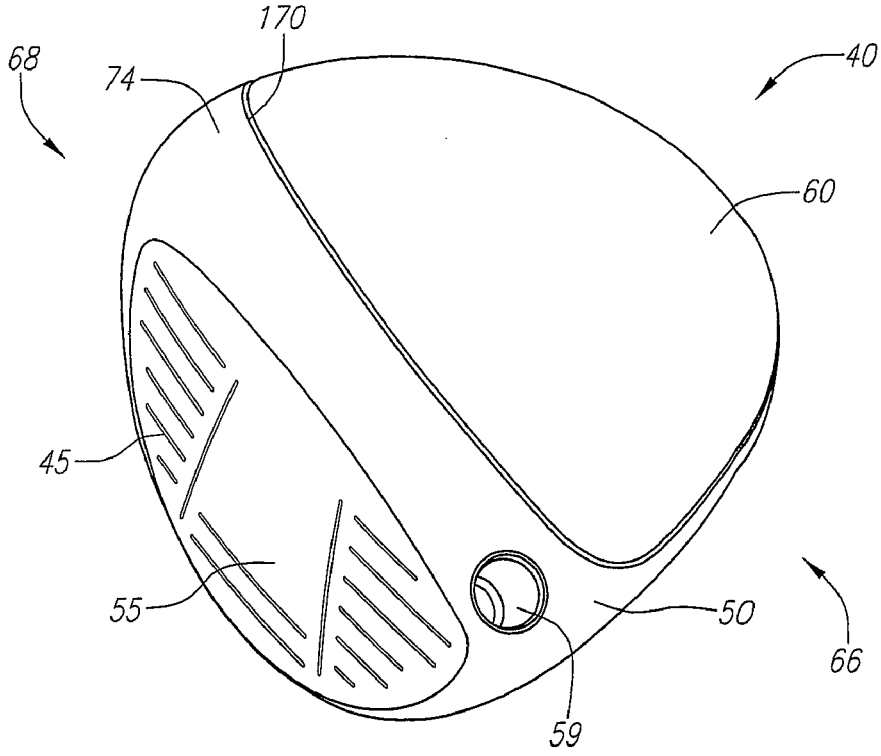
FIG. 1 is a front top perspective view of a golf club head of the present invention.
Figure 2:
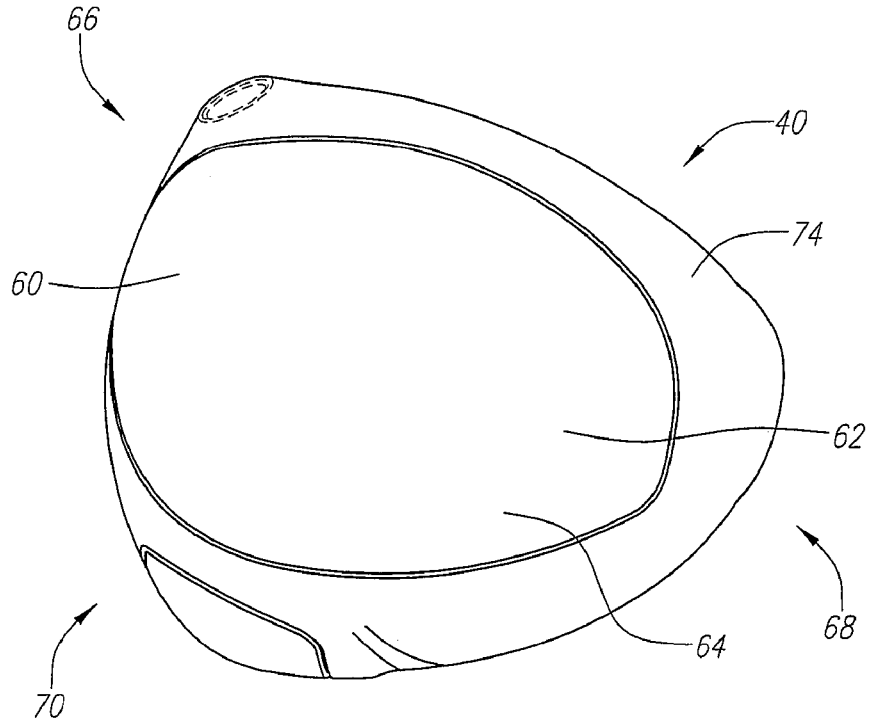
FIG. 2 is a rear top perspective view of the golf club head of FIG. 1.
Figure 3:
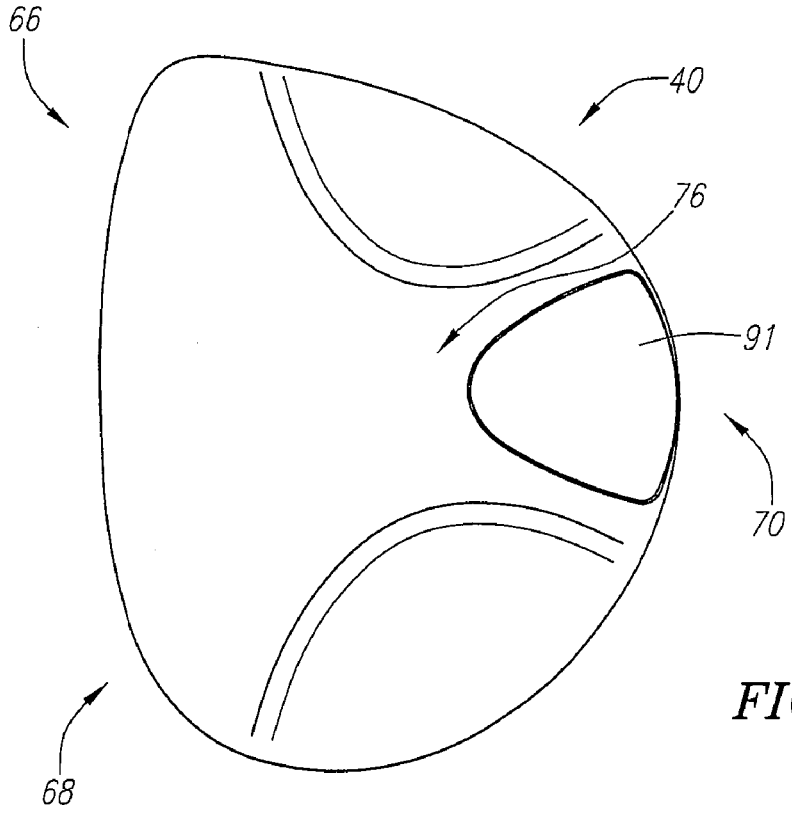
FIG. 3 is bottom plan view of the golf club head of FIG. 1.

As shown in FIGS. 1-8, a golf club head 40 is generally composed of three primary components, a major body 50, a striking plate insert 55 and minor body 60. The minor body 60 has a crown section 62 and a ribbon section 64. The club head 40 may also be partitioned into a heel end 66 nearest the shaft 48, a toe end 68 opposite the heel section 66, and an aft end 70.

The major body 50 is generally composed of a single piece of metal, and is preferably composed of a cast metal material. More preferably, the cast metal material is a stainless steel material or a titanium material such as pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Alternatively, the major body may be manufactured through forging, welding, forming, machining, powdered metal forming, metal-injection-molding, electrochemical milling, and the like.

The major body 50 generally includes a front wall section 72, a return section 74 extending laterally rearward from the upper perimeter of the front wall section 72, a sole section 76 extending laterally rearward from the front wall section 72, a ribbon section 78 extending upward from the sole section 76, and a ledge section 80 stepped inward for attachment of the minor body 60. The front wall section 72 has an opening for placement of the striking plate insert 55 therein.

The return section 74 extends inward, towards the minor body 60, and has a general curvature from the heel end 66 to the toe end 68. The return section 74 has a length from the perimeter 73 of the front wall section 72 that is preferably a minimal length near the center of the front wall section 72, and increases toward the toe end 68 and the heel end 66. A distance d represents the length of the return section 74 from the perimeter 73 at the center of the front wall section 72, a distance d' from the perimeter 73 at the heel end 66 of the front wall section 72, and a distance d" from the perimeter 73 at the toe end 68 of the front wall section 72. In a preferred embodiment, the distance d ranges from 0.2 inch to 1.5 inches, more preferably 0.30 inch to 1.25 inches, and most preferably from 0.60 inch to 1.0 inch, as measured from the perimeter 73 of the front wall section 72 to the rearward edge of the return section 74. In a preferred embodiment, the distance d' ranges from 0.4 inch to 2.00 inches, more preferably 0.50 inch to 1.75 inches, and most preferably from 0.8 inch to 1.50 inches, as measured from the perimeter 73 of the front wall section 72 to the rearward edge of the return section 74. In a preferred embodiment, the distance d" ranges from 0.4 inch to 2.25 inches, more preferably 0.50 inch to 2.00 inches, and most preferably from 0.9 inch to 1.50 inches, as measured from the perimeter 73 of the front wall section 72 to the rearward edge of the return section 74.

The perimeter 73 of the front wall section 72 is defined as the transition point where the major body 50 transitions from a plane substantially parallel to the front wall section 72 to a plane substantially perpendicular to the front wall section 72. Alternatively, one method for determining the transition point is to take a plane parallel to the front wall section 72 and a plane perpendicular to the front wall section 72, and then take a plane at an angle of forty-five degrees to the parallel plane and the perpendicular plane. Where the forty-five degrees plane contacts the major body 50 is the transition point thereby defining the perimeter 73 of the front wall section 72.

The golf club head 40 has striking plate insert 55 that is attached to the major body 50 over the opening 32 of the front wall 72. The striking plate insert 55 is preferably composed of a formed titanium alloy material. Such titanium materials include titanium alloys such as 6-22-22 titanium alloy and Ti 10-2-3 alloy, Beta-C titanium alloy, all available from RTI International Metals of Ohio, SP-700 titanium alloy (available from Nippon Steel of Tokyo, Japan), DAT 55G titanium alloy available from Diado Steel of Tokyo, Japan, and like materials. The preferred material for the striking plate insert 55 is a heat treated 6-22-22 titanium alloy which is a titanium alloy composed by weight of titanium, 6% aluminum, 2% tin, 2% chromium, 2% molybdenum, 2% zirconium and 0.23% silicon. The titanium alloy will have an alpha phase in excess of 40% of the overall microstructure. As shown in FIG. 1, the striking plate insert 55 typically has a plurality of scorelines 45 thereon.

As shown in FIG. 1, the striking plate insert 55 is preferably welded to the front wall section 72 of the major body 50, thereby covering the opening 32. A plurality of tabs, not shown, preferably three, align the striking plate insert 55 for the welding process. Alternatively, the striking plate insert 55 is press-fitted into the opening 32.

The minor body 60 is preferably composed of a low density material, preferably a metal or a polymer material. Preferably metals include magnesium alloys, aluminum alloys, magnesium or aluminum material. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). If metal, the minor body 60 is preferably manufactured through metal-injection-molding, casting, forming, machining, powdered metal forming, electro chemical milling, and the like.

Alternatively, the minor body 60 is composed of a polymer material such as plies of pre-preg material, thermoplastic materials such as polyurethanes, polyesters, polyamides, ionomers, and other similar materials. A preferred non-metal material is a composite material such as continuous fiber pre-preg material (either thermosetting resin or thermoplastic resin). Other materials for the minor body 60 include other thermosetting materials or other thermoplastic materials such as injection molded plastics. If non-metal, the minor body 60 is preferably manufactured through bladder-molding, resin transfer molding, resin infusion, injection molding, compression molding, or a similar process. In a preferred process, the major body 50, with an adhesive on the exterior surface of the ledge section 80, is press-fitted with the minor body 60. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

Figure 4:
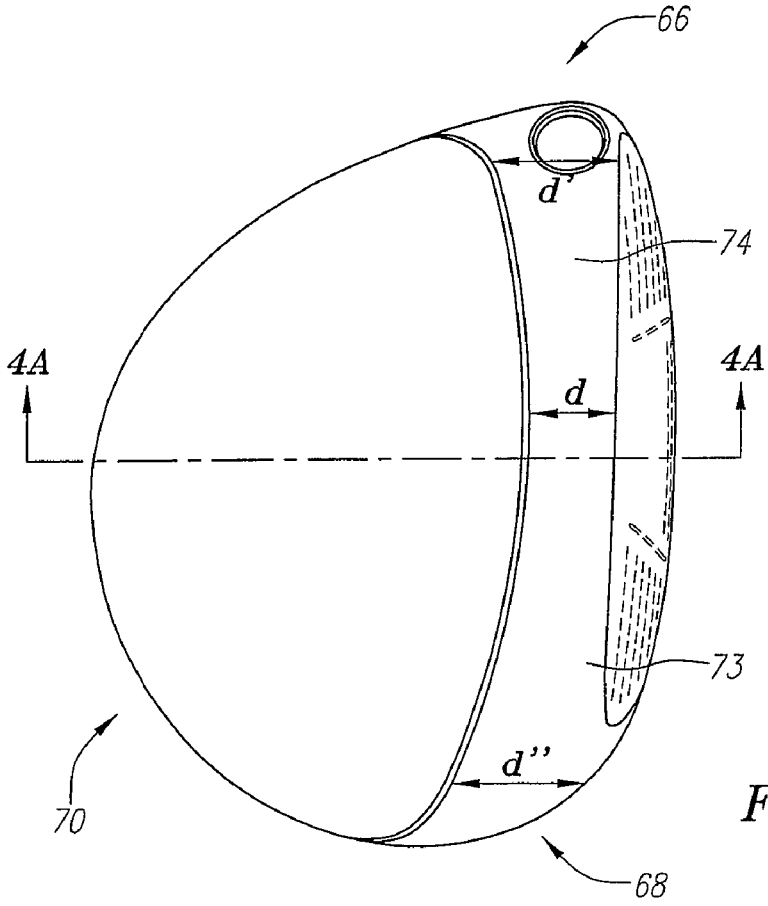
FIG. 4 is a top plan view of the golf club head of FIG. 1.
Figure 4A:
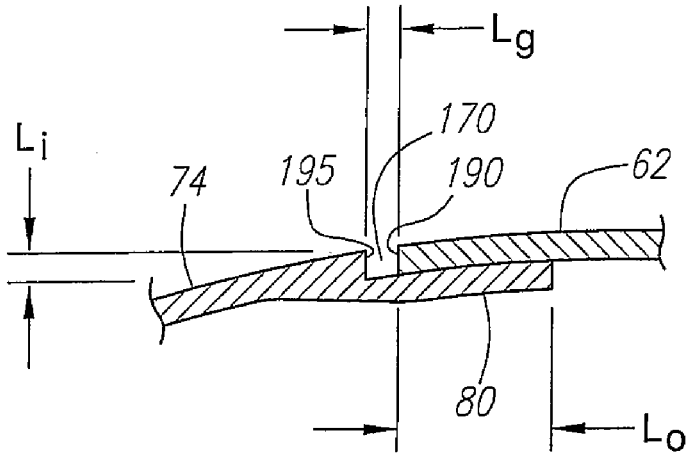
FIG. 4A is an isolated cross-sectional view along line 4A-4A near the striking plate insert.
Figure 4B:
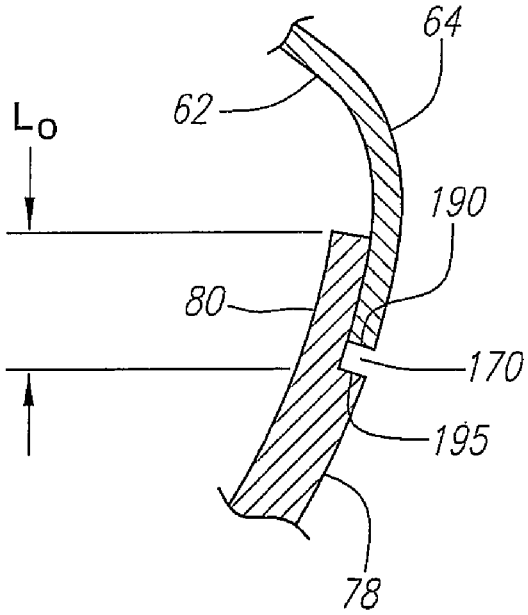
FIG. 4B is an isolated cross-sectional view along line 4A-4A near the aft-end of the golf club head.
Figure 5:
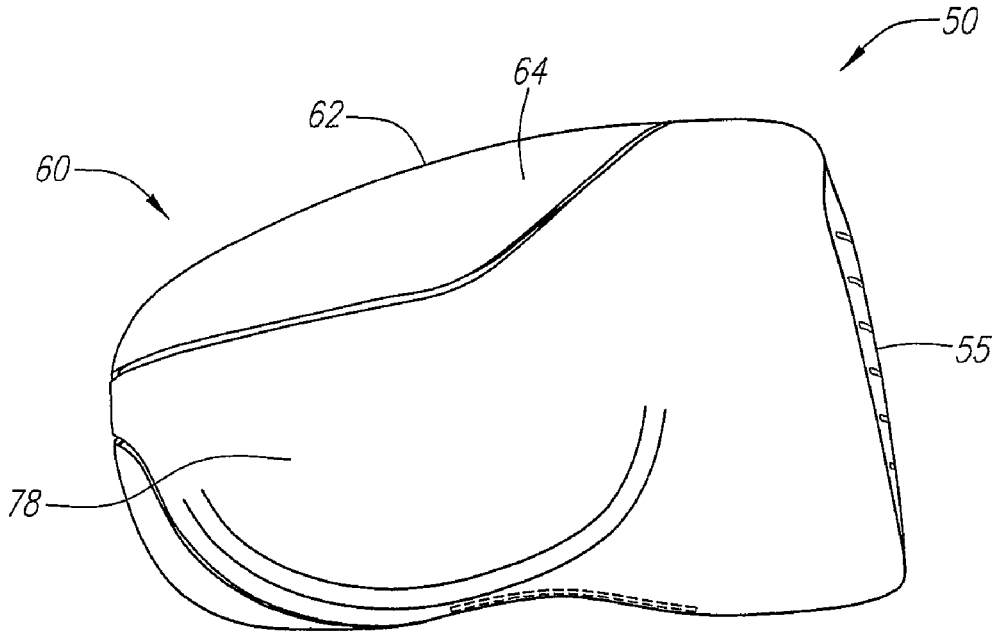
FIG. 5 is a toe side view of the golf club head of FIG. 1.
Figure 6:
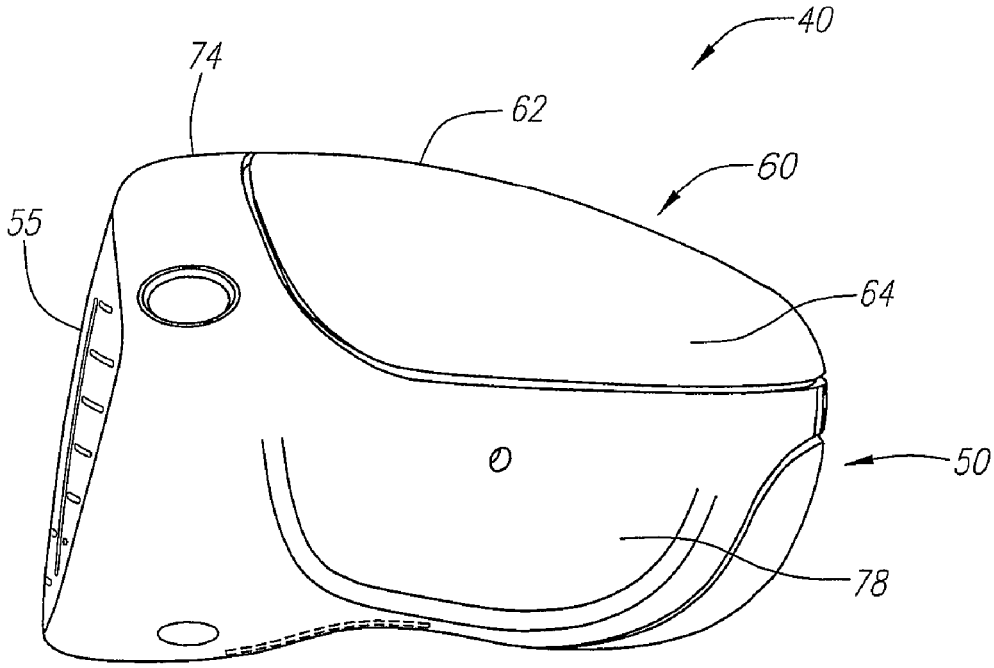
FIG. 6 is a heel side view of the golf club head of FIG. 1.
Figure 8:
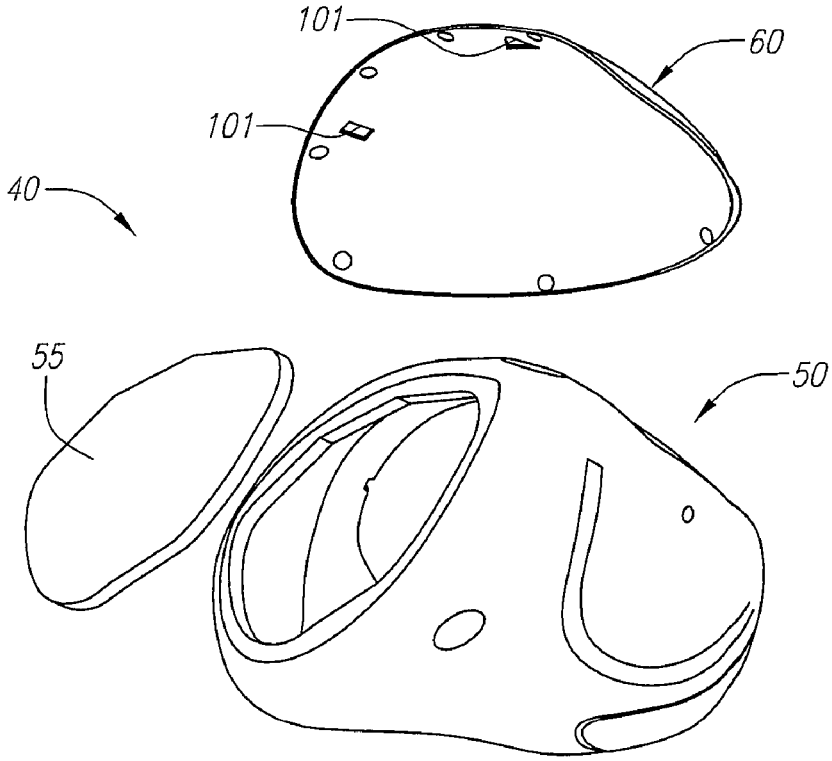
FIG. 8 is an exploded bottom perspective view of the golf club head of the present invention.

As shown specifically in FIGS. 4A and 4B, the minor body 60 overlaps the ledge section 80 a distance Lo, which preferably ranges from 0.10 inch to 1.00 inch, more preferably ranges from 0.40 inch to 0.70 inch, and is most preferably 0.50 inch. The ledge section 80 is preferably inward from the exterior surface of the major body 50 toward the hollow interior 46 a distance Li of 0.005 inch to 0.050 inch, more preferably 0.020 inch to 0.040 inch and most preferably 0.035 inch. The edge 195 of the major body 50 determines the inward distance Li of the ledge section 80. An annular gap 170 is created between an edge 190 of the minor body 60 and the edge 195 of the major body 50. The annular gap 170 has a distance Lg that preferably ranges from 0.020 inch to 0.100 inch, more preferably from 0.050 inch to 0.070 inch, and is most preferably 0.060 inch. An optional projection from an exterior surface of the ledge section 80 may establish a minimum bond thickness between the interior surface of the ledge section 80 and the overlapping portion of the minor body 60. The bond thickness preferably ranges from 0.002 inch to 0.100 inch, more preferably ranges from 0.005 inch to 0.040 inch, and is most preferably 0.0150 inch. A liquid adhesive preferably secures the minor body 60 to the ledge section 80 of the major body 50. A plurality of stop gaps 101 (as shown in FIG. 8) on the interior surface of the minor body 60 assist in creating the annular gap 170.

The crown section 62 of the minor body 60 is generally convex toward the sole section 76, and transitions into the ribbon section 64. The crown section 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The ribbon section 64 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch.

In a preferred embodiment, the minor body 60 is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety.

The sole section 76 of the major body 50 is generally convex toward the crown section 62 with a dual keel shape. The sole section 76 alternatively has a recess for attachment of a sole plate 91 thereto. The sole plate 91 is preferably attached with a pressure sensitive adhesive such as a polyethylene foam acrylic adhesive sold by the 3M company. The sole plate 91 is preferably composed of a light weight metal such as aluminum, titanium or titanium alloy. Alternatively, the sole plate 91 is composed of a durable plastic material. The sole plate 91 may have graphics thereon for designation of the brand of club and loft.

Figure 7:
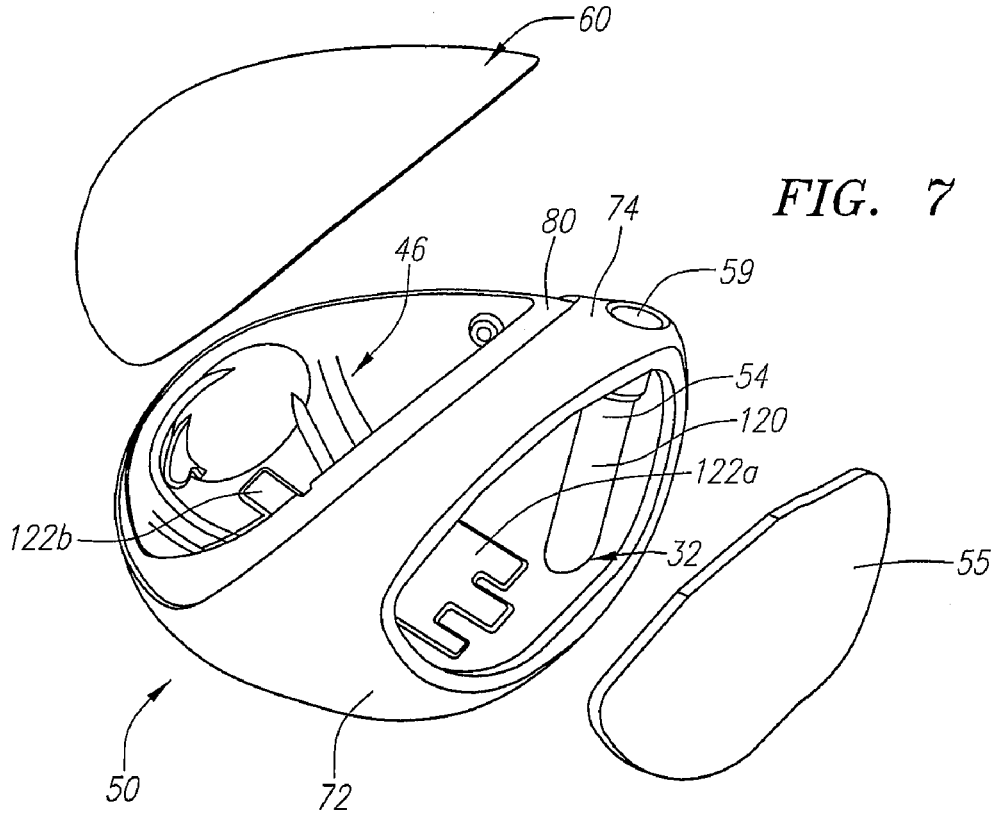
FIG. 7 is an exploded top perspective view of the golf club head of the present invention.

FIG. 7 illustrates the hollow interior 46 of the club head 40 of the present invention. The hosel 54 is preferably disposed within the hollow interior 46, and is preferably integral with the major body 50. The hosel 54 is preferably cast with the major body 50. Additionally, the hosel 54 may be composed of a non-similar material that is light weight and secured using bonding or other mechanical securing techniques. A hollow interior of the hosel 54 is defined by a hosel wall 120 that forms a tapering tube from the aperture 59 to the sole section 76. A shaft is preferably disposed within a hosel insert that is disposed within the hosel 54. Such a hosel insert and hosel 54 are described in U.S. Pat. No. 6,352,482, entitled Golf Club With Hosel Liner, which pertinent parts are hereby incorporated by reference. Alternatively, an exterior hosel may be utilized with the golf club head 40.

Stiffening members 122 are utilized to control the frequency of the sole section 76 of the golf club head which affects the sound generated by the golf club head 40 during impact with a golf ball. As shown in FIG. 7, a central stiffening member 122*a* is preferably positioned within the hollow interior 46 of the club head 40. In a preferred embodiment, the central stiffening member 122*a* is preferably disposed on the interior surface of the sole section 76 in order to stiffen the major body and control the center of gravity of the golf club head 40. A rear stiffening member 122*b* is preferably placed adjacent the aft-end of the golf club head 40 on the interior surface of the sole section 76. In this embodiment, each of the stiffening members 122*a* and 122*b* is a relatively flat plate. Those skilled in the pertinent art will recognize that these or additional stiffening members may be placed in other locations of the club head 40 in order to influence the center of gravity, moment of inertia, or other inherent properties of the golf club head 40. The stiffening members 122*a* and 122*b* are preferably thickened areas of the major body 50, or external ribs or weight chips welded to the interior surface of the major body 50. In a preferred embodiment, each of the stiffening members is composed of the same or similar material as the major body 50. Those skilled in the pertinent art will recognize that other high density materials may be utilized as a stiffening member 122 without departing from the scope and spirit of the present invention.

Figure 11:
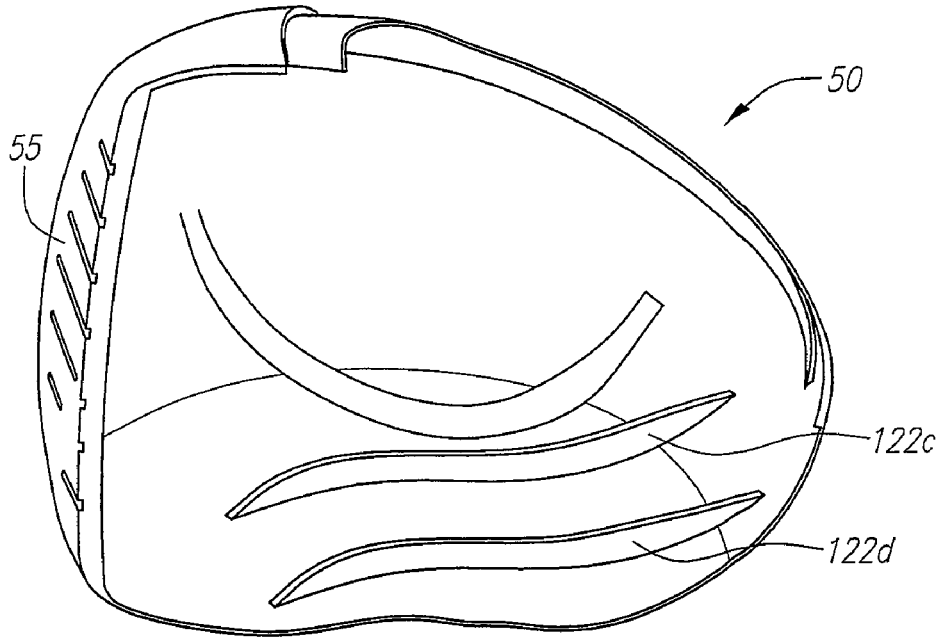
FIG. 11 is a cut-away view of the toe end of the major body of the golf club head with the striking plate insert illustrating one embodiment of the stiffening members.
Figure 12:
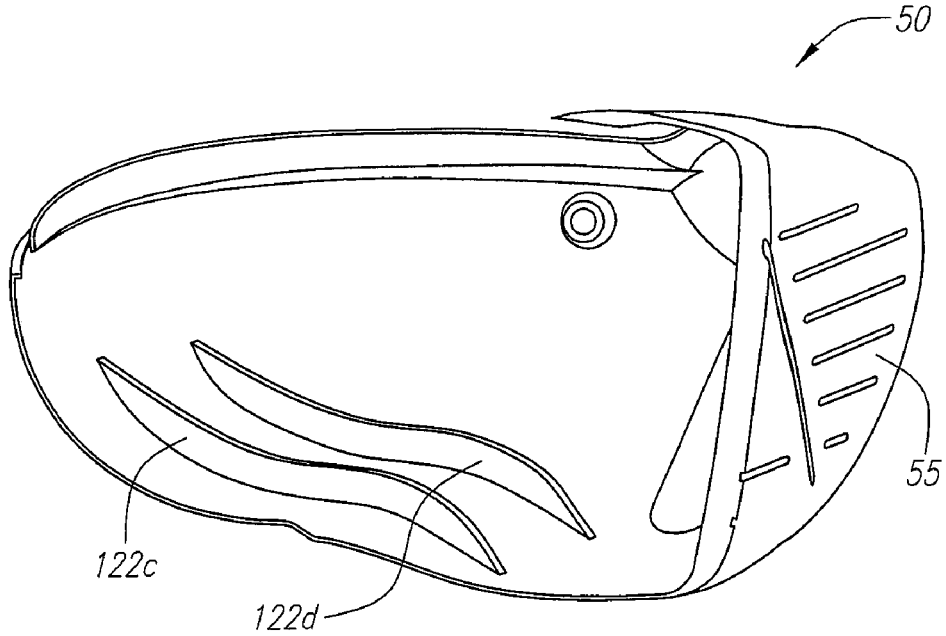
FIG. 12 is a cut-away view of the heel end of the major body of FIG. 11.
Figure 13:
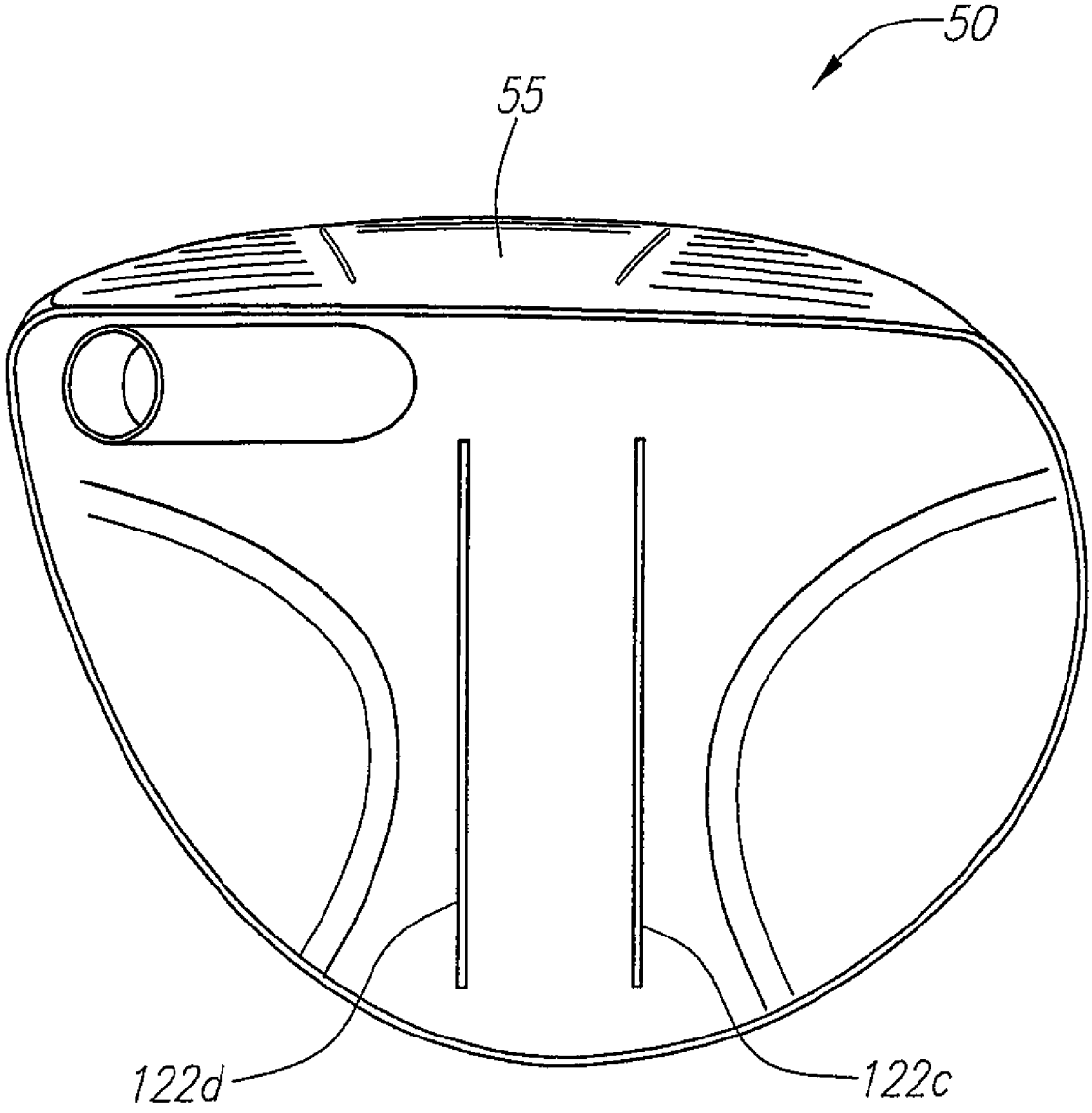
FIG. 13 is a top plan view of the full major body of FIG. 11.

In an alternative embodiment shown in FIGS. 11-13, a pair of stiffening members 122*c* and 122*d* are located on an interior surface of the sole section 76. Each of the pair of stiffening members 122*c* and 122*d* is a thickened area of the sole section 76 in the form of an elongate rib with a thickness ranging from 0.050 inch to 0.500 inch, more preferably from 0.100 inch to 0.400 inch and most preferably 0.375 inch. The height of each stiffening member 122 preferably ranges from 0.05 inch to 0.50 inch, and more preferably from 0.10 inch to 0.30 inch.

FIGS. 14-21 illustrate various embodiments of stiffening members disposed on the interior surface of the sole section 76. Although the stiffening members shown in FIGS. 14-21 are depicted as being on the exterior surface of the sole section 76, these stiffening members are actually disposed on the interior surface of the sole section 76. Thus, the stiffening members are located inside the golf club head 40. Table One illustrates the variations of these embodiments and the affects that the stiffening members have the frequency of the golf club head 40.

TABLE ONE

Figure 14:
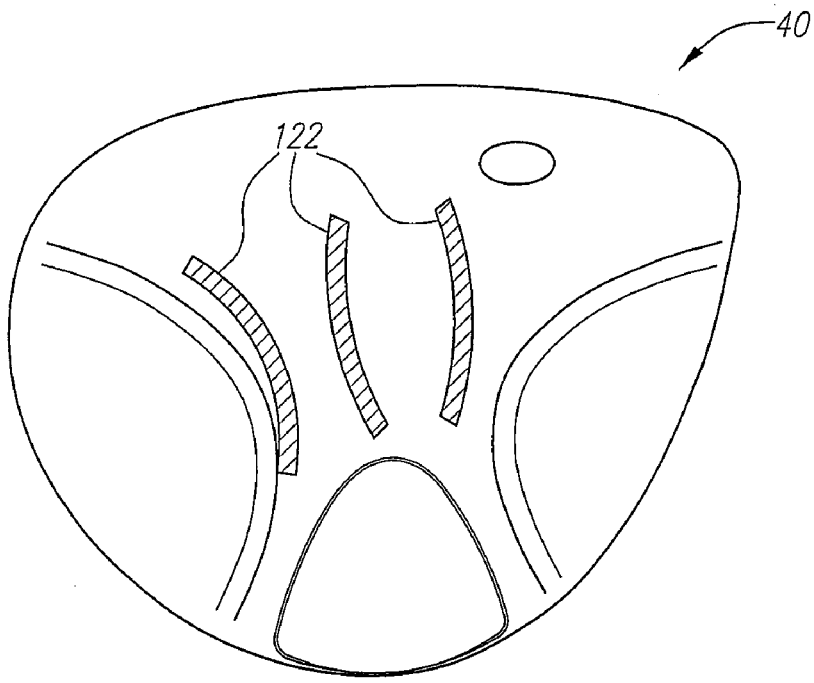
FIG. 14 is a bottom plan view of a golf club head with an alternative embodiment of the stiffening members superimposed on the exterior sole section.
Figure 15:
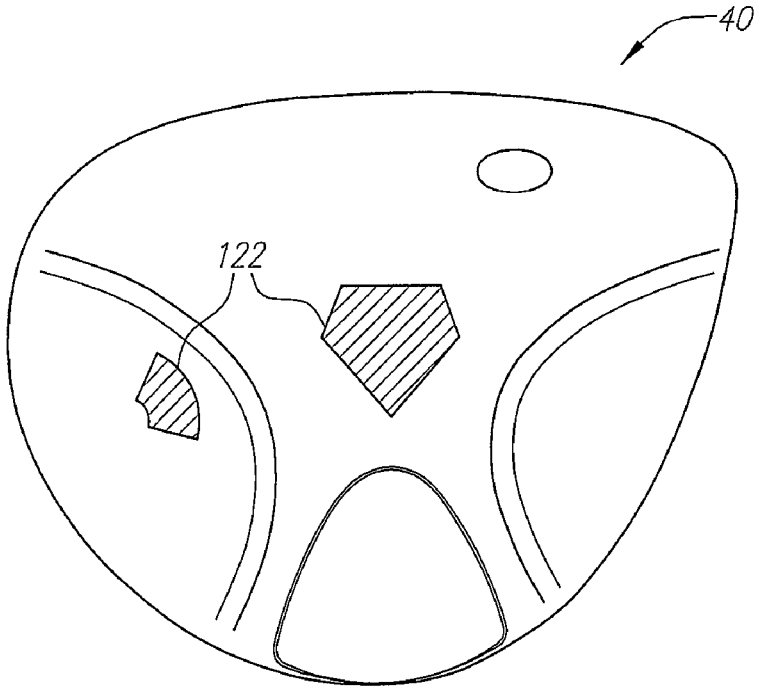
FIG. 15 is a bottom plan view of a golf club head with an alternative embodiment of the stiffening members superimposed on the exterior sole section.
Figure 16:
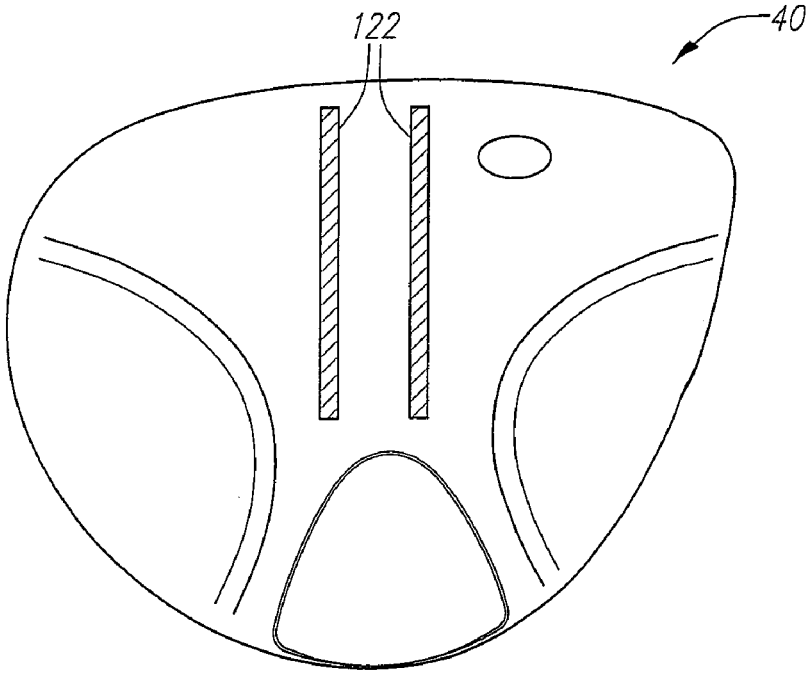
FIG. 16 is a bottom plan view of a golf club head with an alternative embodiment of the stiffening members superimposed on the exterior sole section.
Figure 17:
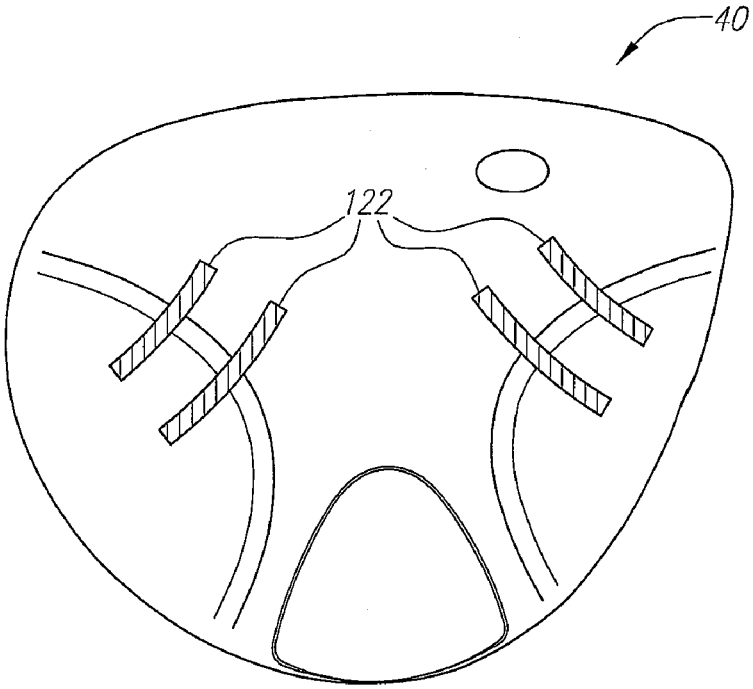
FIG. 17 is a bottom plan view of a golf club head with an alternative embodiment of the stiffening members superimposed on the exterior sole section.
Figure 18:
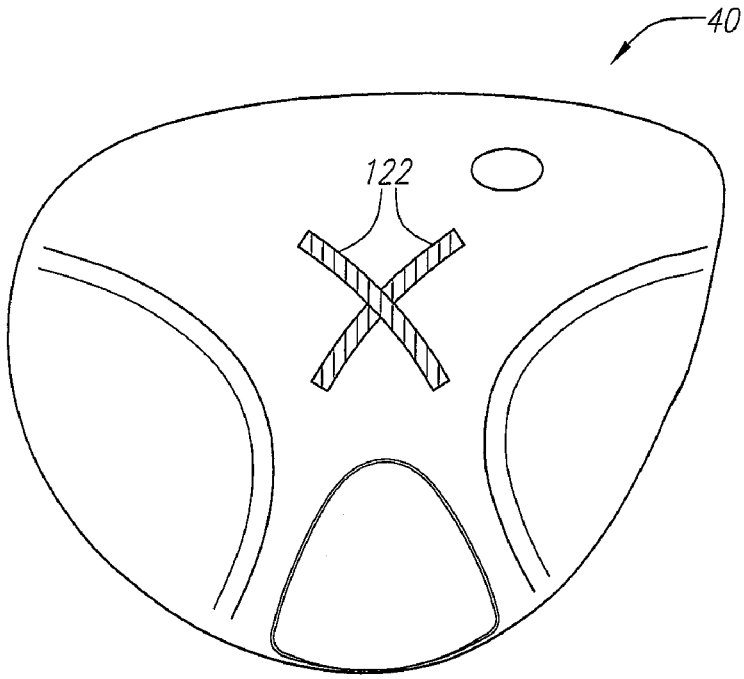
FIG. 18 is a bottom plan view of a golf club head with an alternative embodiment of the stiffening members superimposed on the exterior sole section.
Figure 19:
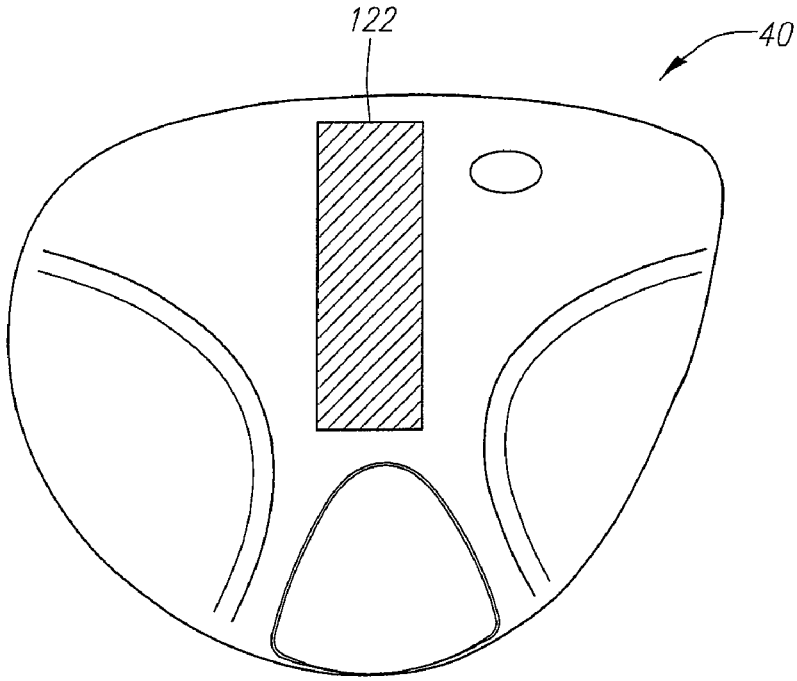
FIG. 19 is a bottom plan view of a golf club head with an alternative embodiment of the stiffening members superimposed on the exterior sole section.
Figure 20:
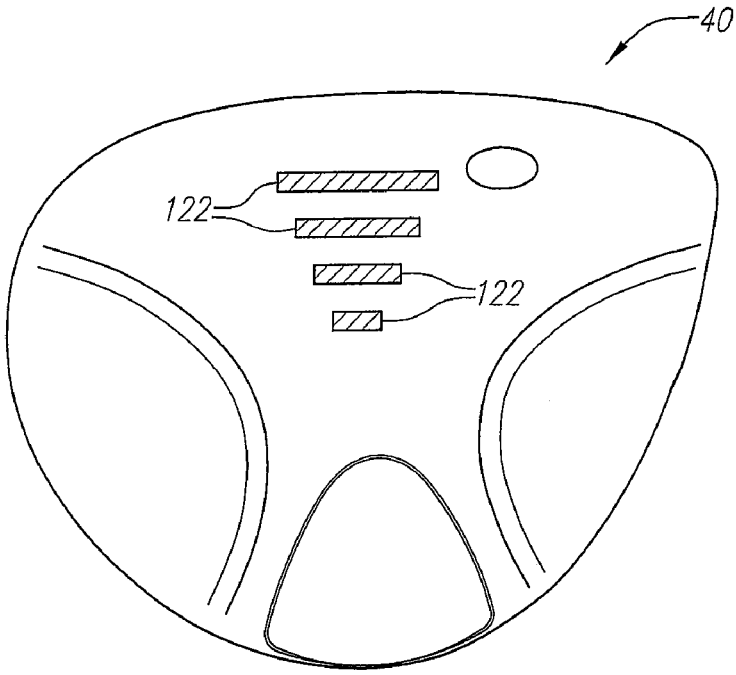
FIG. 20 is a bottom plan view of a golf club head with an alternative embodiment of the stiffening members superimposed on the exterior sole section.
Figure 21:
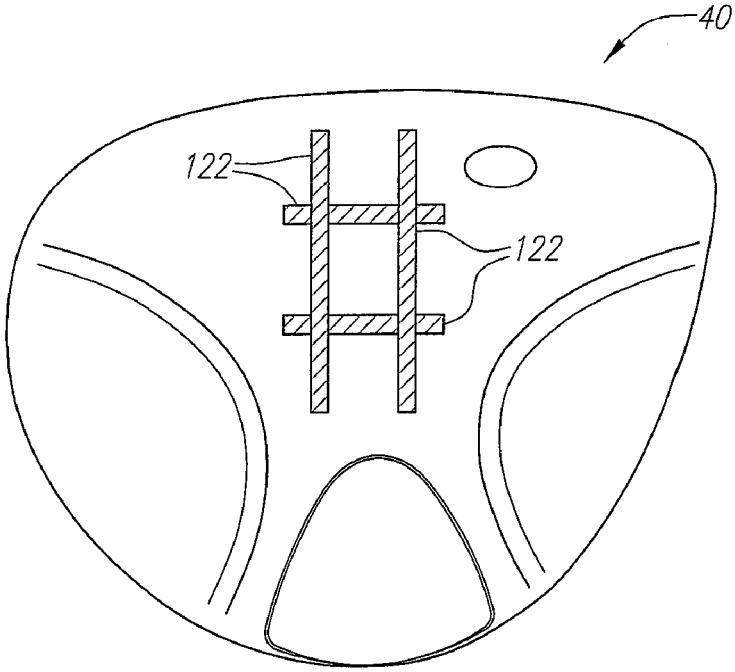
FIG. 21 is a bottom plan view of a golf club head with an alternative embodiment of the stiffening members superimposed on the exterior sole section.

| Embodiment | Mass (grams) | Mode 1 (Hertz) | Mode 2 (Hertz) |
|---|---|---|---|
| Baseline | 188.1 | 2161 | 2508 |
| Baseline +0.005 | 194.0 | 2336 | 2705 |
| FIG. 14 | 193.7 | 2453 | 2869 |
| FIG. 15 | 193.5 | 2080 | 2416 |
| FIG. 16 | 193.0 | 2549 | 2727 |
| FIG. 11 | 201.7 | 2764 | 3442 |
| FIG. 17 | 193.7 | 2163 | 2474 |
| FIG. 18 | 197.9 | 2315 | 2678 |
| FIG. 19 | 192.3 | 2177 | 2599 |
| FIG. 20 | 194.7 | 2042 | 2443 |
| FIG. 21 | 193.8 | 2421 | 2599 |

As shown in TABLE ONE, the embodiment of FIG. 11 has the greatest frequency, in both Mode 1 and Mode 2. The testing procedure for the test results for Table One is set forth in U.S. Pat. No. 6,585,605, which is hereby incorporated by reference. The procedure is the same as described in U.S. Pat. No. 6,585,605 except that the accelerometer used is moved to each region of interest (sole and crown) instead of remaining on the face. The face is still struck to generate vibrations in the sole section. The first and second modes correspond to the two resonant frequencies on a frequency response curve.

The baseline is a golf club head 40 as disclosed above except without stiffening members. Each of the embodiments has variations of stiffening members 122. FIG. 14 has three stiffening members 122 in the form of elongate ribs having a thickness of 0.250 inch. FIG. 15 has two stiffening members 122 in the form of plates having a thickness of 0.100 inch. FIG. 16 has two stiffening members 122 in the form of ribs having a thickness of 0.250 inch. FIG. 17 has four stiffening members 122 in the form of ribs having a thickness of 0.375 inch. FIG. 18 has two stiffening members 122 in the form of crossing ribs having a thickness of 0.375 inch. FIG. 19 has one stiffening member 122 in the form of a plate having a thickness of 0.050 inch. FIG. 20 has four parallel stiffening members 122 in the form of ribs having a thickness of 0.250 inch. FIG. 21 has four stiffening members 122 in the form of ribs having a thickness of 0.250 inch.

An alternative use of stiffening members is to influence the center of gravity of the a golf club head as disclosed in U.S. Pat. No. 6,739,983, for a Golf Club Head With Customizable Center Of Gravity, and assigned to Callaway Golf Company, which is hereby incorporated by reference in its entirety.

Variable face thickness patterns of the striking plate insert 55 are disclosed in U.S. Pat. No. 6,471,603, for a Contoured Golf Club Face, U.S. Pat. No. 6,368,234 for a Golf Club Striking Plate Having Elliptical Regions Of Thickness, and U.S. Pat. No. 6,398,666 for a Golf Club Striking Plate With Variable Thickness, which are all owned by Callaway Golf Company and which pertinent parts are hereby incorporated by reference.

Preferably, the major body 50 is cast from molten metal in a method such as the well-known lost-wax casting method. The metal for casting is preferably 17-4 stainless steel. Additional methods for manufacturing the major body 50 include forming the major body 50 from a flat sheet of metal, superplastic forming the major body 50 from a flat sheet of metal, machining the major body 50 from a solid block of metal, electrochemical milling the major body 50 from a forged pre-form, and like manufacturing methods. Yet further methods include diffusion bonding titanium or steel sheets to yield a variable face thickness face and then superplastic forming.

The present invention is directed at a golf club head that has a high coefficient of restitution thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The mass of the club head 40 of the present invention ranges from 165 grams to 250 grams, preferably ranges from 175 grams to 230 grams, and most preferably from 190 grams to 205 grams. Preferably, the major body 50 has a mass ranging from 140 grams to 200 grams, more preferably ranging from 150 grams to 180 grams, yet more preferably from 155 grams to 166 grams, and most preferably 161 grams. The minor body 60 has a mass preferably ranging from 4 grams to 20 grams, more preferably from 5 grams to 15 grams, and most preferably 7 grams. Each stiffening member 122 has a mass preferably ranging from 1 gram to 50 grams, more preferably from 5 grams to 25 grams, and most preferably 10 grams. Additionally, epoxy, or other like flowable materials, in an amount ranging from 0.5 grams to 5 grams, may be injected into the hollow interior 46 of the golf club head 40 for selective weighting thereof.

The golf club head 40 preferably has that ranges from 290 cubic centimeters to 600 cubic centimeters, and more preferably ranges from 330 cubic centimeters to 510 cubic centimeters, even more preferably 350 cubic centimeters to 495 cubic centimeters, and most preferably 415 cubic centimeters or 460 cubic centimeters.

Figure 9:
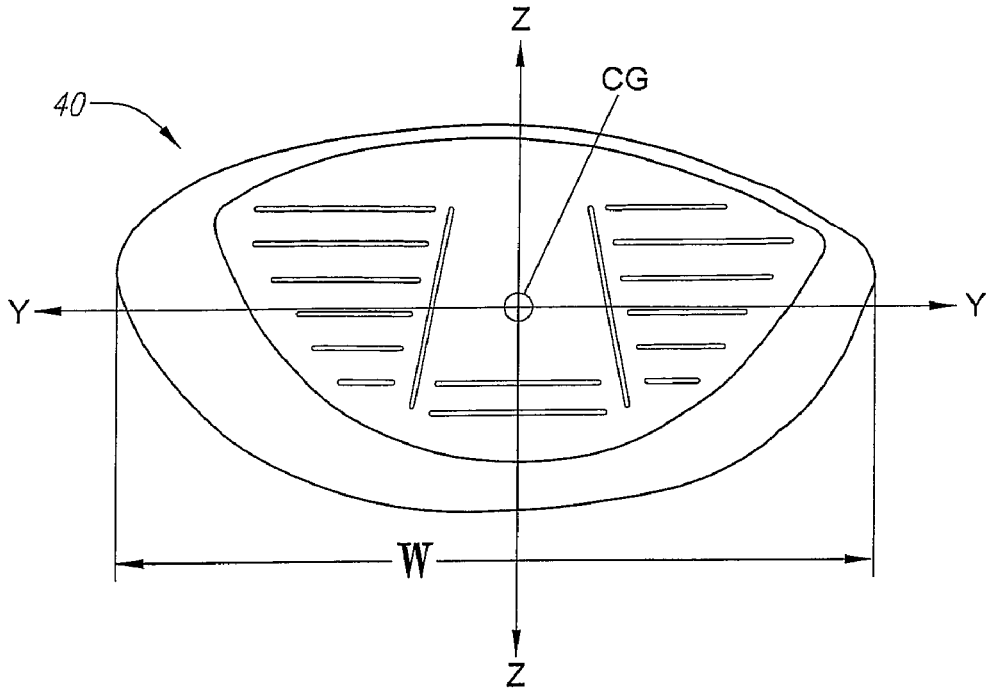
FIG. 9 is a front plan view of a golf club of the present invention illustrating the Z axis and Y axis, and also the width of the golf club head.
Figure 10:
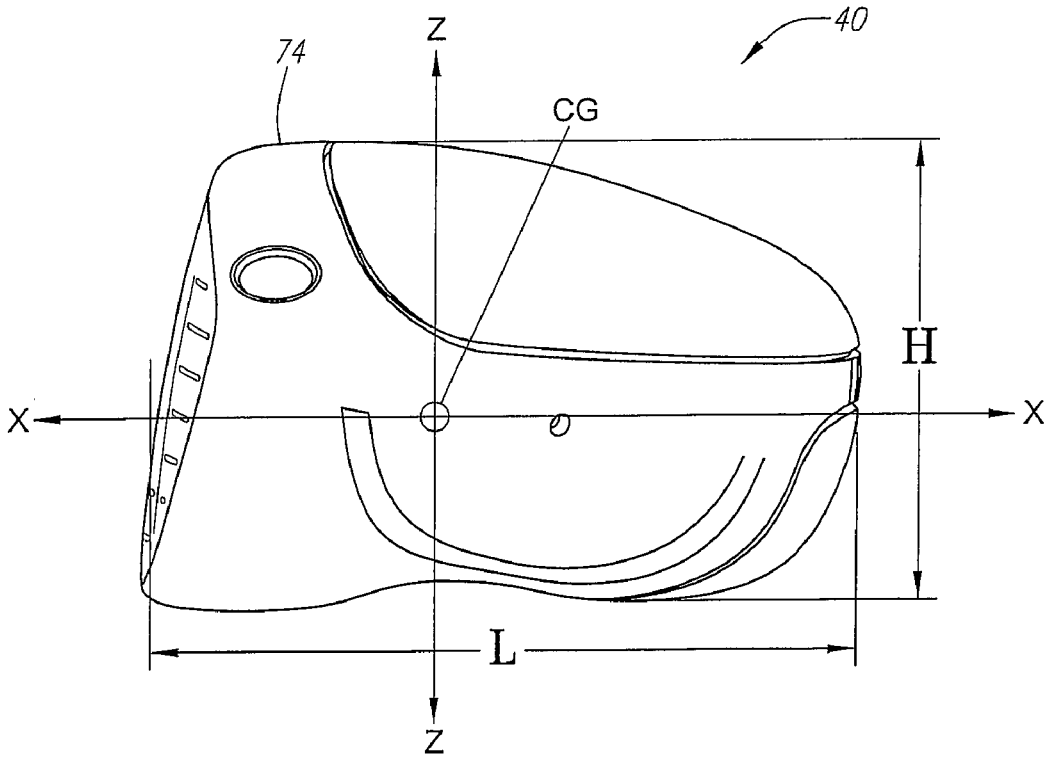
FIG. 10 is a heel side plan view of a golf club of the present invention illustrating the Z axis and X axis, and also the length and height of the golf club head.

FIGS. 9 and 10 illustrate the axes of inertia through the center of gravity of the golf club head. The axes of inertia are designated X, Y and Z. The X axis extends from the striking plate insert 55 through the center of gravity, CG, and to the rear of the golf club head 40. The Y axis extends from the toe end 68 of the golf club head 40 through the center of gravity, CG, and to the heel end 66 of the golf club head 40. The Z axis extends from the crown section 62 through the center of gravity, CG, and to the sole section 76.

As defined in GolfClub Design, Fitting, Alteration & Repair, $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in Golf Club Design, Fitting, Alteration & Repair.

The center of gravity and the moment of inertia of a golf club head 40 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety.

In general, the moment of inertia, Izz, about the Z axis for the golf club head 40 preferably ranges from 2800 g-cm$^2$ to 5000 g-cm$^2$, preferably from 3000 g-cm$^2$ to 4500 g-cm$^2$, and most preferably from 3750 g-cm$^2$ to 4250 g-cm$^2$. The moment of inertia, Iyy, about the Y axis for the golf club head 40 preferably ranges from 1500 g-cm$^2$ to 4000 g-cm$^2$, preferably from 2000 g-cm$^2$ to 3500 g-cm$^2$, and most preferably from 2400 g-cm$^2$ to 2900 g-cm$^2$. The moment of inertia, Ixx, about the X axis for the golf club head 40 preferably ranges from 1500 g-cm$^2$ to 4000 g-cm$^2$, preferably from 2000 g-cm$^2$ to 3500 g-cm$^2$, and most preferably from 2500 g-cm$^2$ to 3000 g-cm$^2$.

In general, the golf club head 40 has products of inertia such as disclosed in U.S. Pat. No. 6,425,832, and is hereby incorporated by reference in its entirety. Preferably, each of the products of inertia, Ixy, Ixz and Iyz, of the golf club head 40 have an absolute value less than 100 grams-centimeter squared. Alternatively, the golf club head 40 has a at least one or two products of inertia, Ixy, Ixz and Iyz, with an absolute value less than 100 grams-centimeter squared.

As shown in FIGS. 9 and 10, the width, W, preferably ranges from 4.0 inches to 5.5 inches, and most preferably from 4.75 inches to 5.0 inches. The height, H, preferably ranges from 2.0 inches to 3.0 inches, and most preferably ranges from 2.40 inches to 2.65 inches. The length, L, preferably ranges from 3.5 inches to 4.5 inches, and most preferably from 4.0 inches to 4.25 inches. The golf club head 40 may have an aspect ratio such as disclosed in U.S. Pat. No. 6,338,683 for a Striking Plate For A GolfClub Head, assigned to Callaway Golf Company, and which pertinent parts are hereby incorporated by reference.

Figure 22:
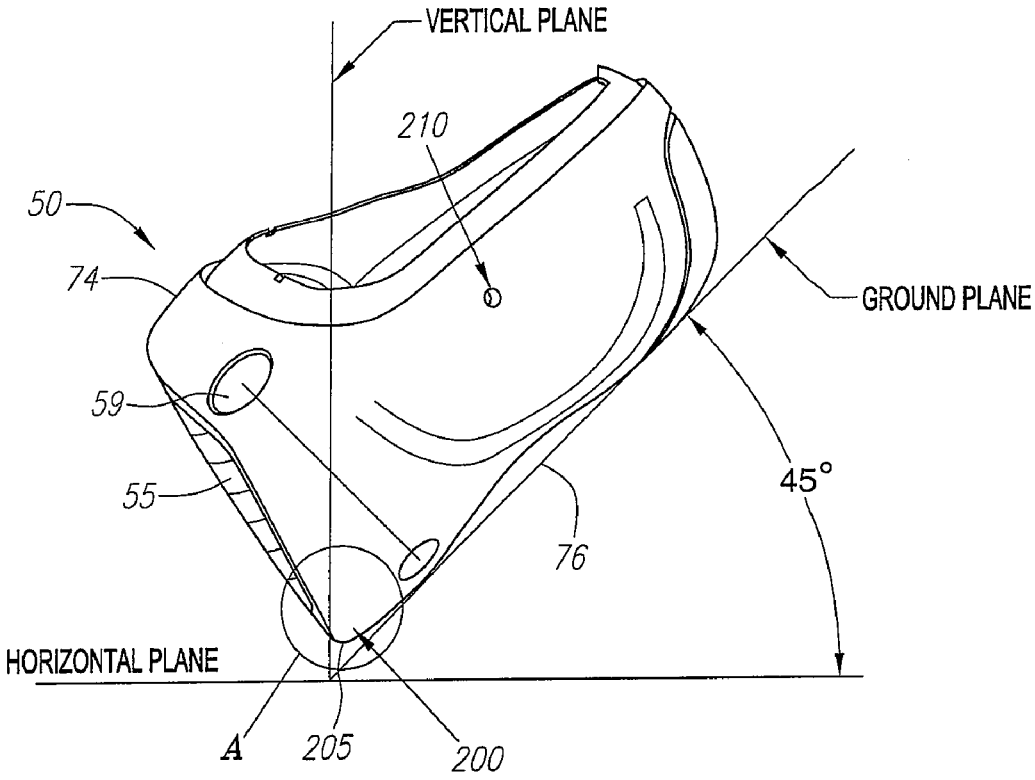
FIG. 22 is a side-view of a major body of a golf club head positioned for introduction of an epoxy-based composition.
Figure 23:
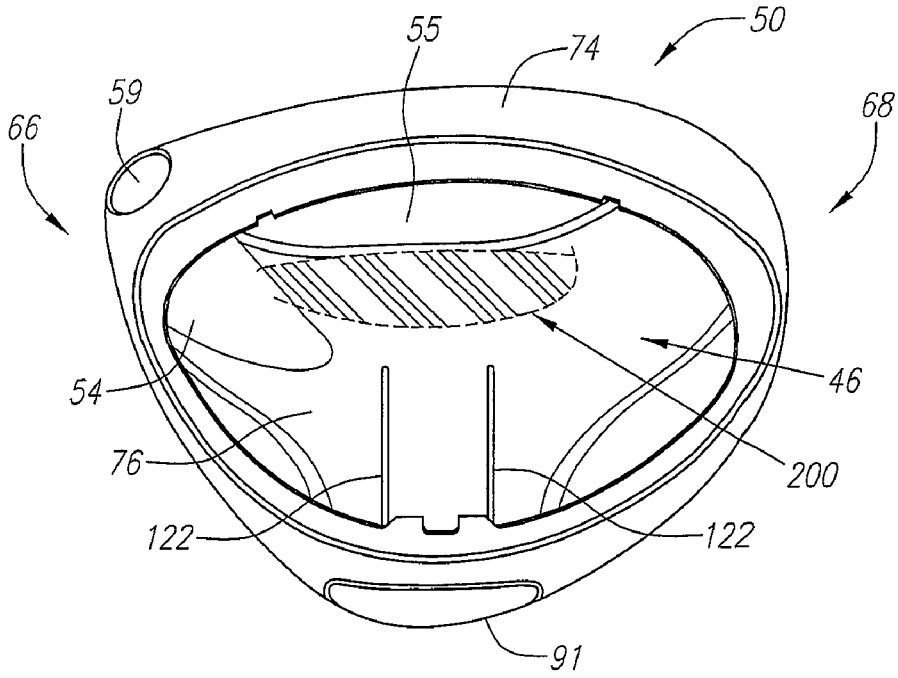
FIG. 23 is an open top plan view of a major body of a golf club head with an epoxy-based composition in a face-sole junction.

As shown in FIGS. 22 and 23, a preferred embodiment of the golf club head 50 includes an epoxy-based composition 200 positioned at a face-sole junction 205 in order to reduce the amplitude level of the golf head 50 during impact with a golf ball at a swing speed from 80 miles per hour ("MPH") to 130 MPH. A golf club head 50 without the epoxy-based composition has an amplitude level of approximately 118 decibels. A golf club head 50 with an epoxy-based composition 200 at the face-sole junction has an amplitude level of approximately 110 decibels.

In a preferred embodiment, the amount of epoxy-based composition 200 preferably ranges from 3 grams to 10 grams, and is most preferably approximately 5 grams. Various epoxy-based compositions are disclosed in U.S. Pat. No. 5,351,958 for Particle Retention In Golf Club Metal Wood Head, which is assigned to Callaway Golf Company of Carlsbad, Calif., and which pertinent parts concerning the epoxy-based compositions are hereby incorporated by reference.

In a preferred embodiment, the epoxy-based composition 200 extends from 1.0 inch to 4.0 inches in a heel end 66 to toe end 68 direction along the face-sole junction 205, and most preferably 2.0 inches to 3.5 inches along the face-sole junction 205.

Figure 22A:
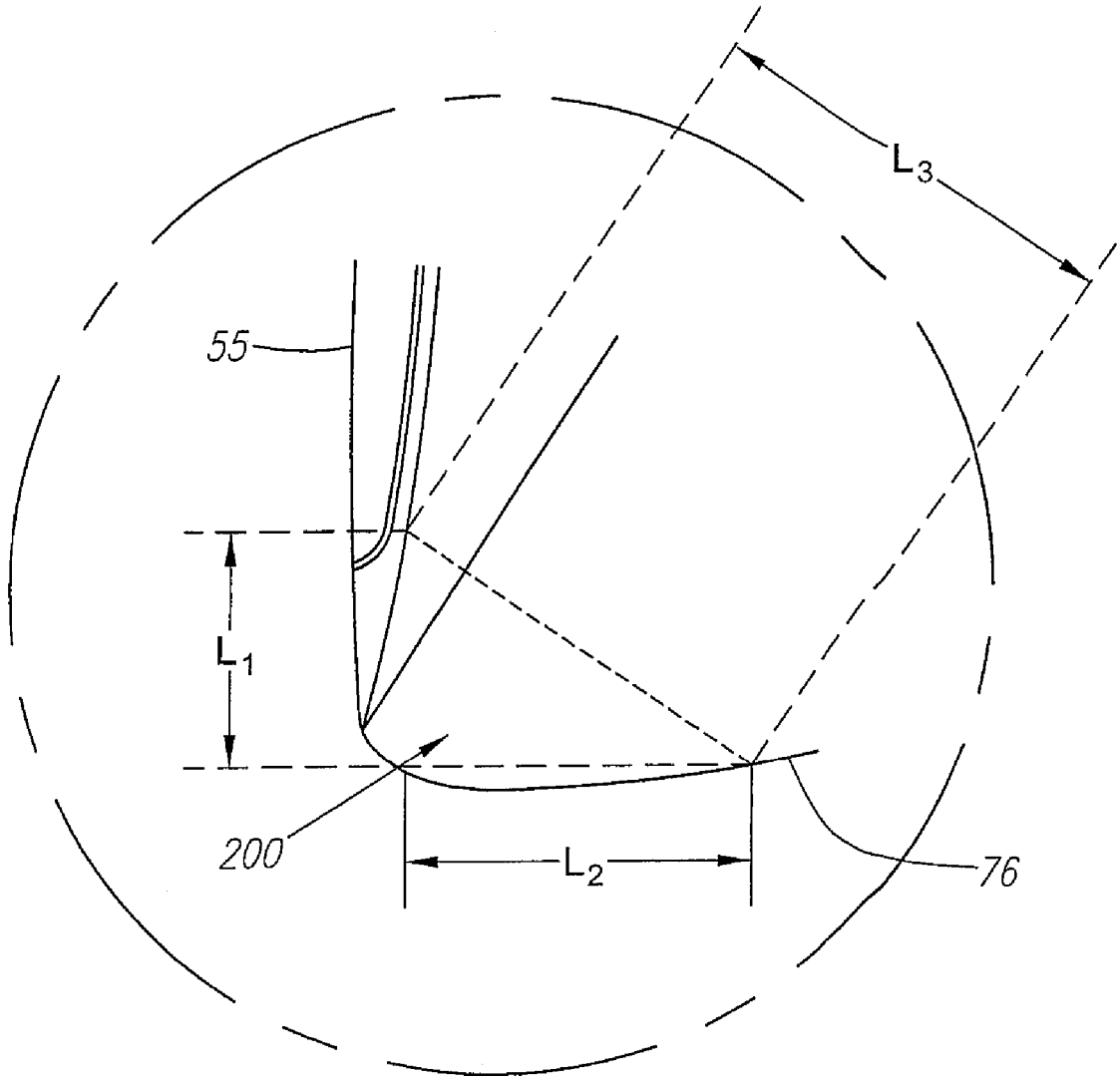
FIG. 22A is an isolated view of circle A of FIG. 22.

As shown in FIG. 22A, the preferred dimensions of the epoxy-based composition 200 are from 0.25 inch to 2.0 inches for length $L_3$, 0.250 inch to 1.5 inches for length $L_2$, and 0.250 inch to 1.5 inches for length $L_1$. Preferably, the epoxy-based composition 200 contacts a portion of the interior surface of the striking plate insert 55, a portion of the interior surface of the sole section 76, and a portion of the interior surface of the front wall 72. Placement of the epoxy-based composition 200 at the face-sole junction 205 reduces the amplitude to the greatest extent with the smallest amount of epoxy-based composition 200.

The epoxy-based composition 200 is preferably introduced through a glue port 210 in the major body 50 when the minor body 60 is attached to the major body 50. Alternatively, the epoxy-based composition 200 is introduced into the major body 50 prior to attachment of the minor body 60. The golf club head 40 is preferably held at a 45 degree angle during the placement of the epoxy-based composition into the hollow interior 46 in order to properly position the epoxy-based composition 200. The epoxy-based composition 200 is preferably heated to a melting temperature prior to introduction into the golf club head 40. Once the epoxy-based composition 200 is positioned at the face sole junction 205, the epoxy is allowed to cool and solidify.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body composed of a titanium alloy material;

wherein a moment of inertia about a Izz axis through a center of gravity of the golf club head that ranges from 2800 to 5000 grams-centimeters squared, a moment of inertia about a Ixx axis through the center of gravity of the golf club head that ranges from 2000 to 3500 grams-centimeters squared and a moment of inertia about a Iyy axis through the center of gravity of the golf club head that ranges from 2000 to 3500 grams-centimeters squared;

wherein the golf club head has a length ranging from 3.5 inches to 4.5 inches and a width ranging from 4.0 inches to 5.5 inches;

wherein the golf club head has a volume ranging from 350 cubic centimeters to 495 cubic centimeters;

wherein the golf club head has an amplitude level of less than 118 decibels when impacting a golf ball at a swing speed ranging from 80 MPH to 130 MPH.

2. The golf club head according to claim 1 wherein the golf club head has an amplitude level of approximately 110 decibels when impacting a golf ball at a swing speed ranging from 80 MPH to 130 MPH.

* * * * *